US006604626B1

(12) United States Patent
Hanshaw

(10) Patent No.: US 6,604,626 B1
(45) Date of Patent: Aug. 12, 2003

(54) COIN DISPLAY CASE

(76) Inventor: Keith A. Hanshaw, 311 Dallas Dr., Grantville, PA (US) 17028

( * ) Notice: Subject to any disclaimer, the term of this patent is extended or adjusted under 35 U.S.C. 154(b) by 42 days.

(21) Appl. No.: 10/067,268

(22) Filed: Feb. 7, 2002

(51) Int. Cl.[7] ..... A45C 1/00
(52) U.S. Cl. ..... 206/0.81; 206/0.84; 206/459.5
(58) Field of Search ..... 206/223, 0.8, 0.81, 206/0.82, 0.83, 0.84, 216, 449, 457, 459.5; 312/114, 125, 135, 136, 330.1; 211/163, 165, 13.1

(56) References Cited

U.S. PATENT DOCUMENTS

| | | | | | |
|---|---|---|---|---|---|
| 3,474,897 | A | | 10/1969 | Rambow | |
| 3,624,832 | A | * | 11/1971 | Dunn | 206/0.83 |
| 3,776,643 | A | | 12/1973 | Titoff | |
| 3,837,475 | A | | 9/1974 | Bolanz | |
| 3,844,410 | A | | 10/1974 | Cook | |
| 4,043,477 | A | | 8/1977 | Deese | |
| 4,063,639 | A | * | 12/1977 | Grant | 206/0.82 |
| 4,402,399 | A | | 9/1983 | Friess | |
| 4,781,290 | A | * | 11/1988 | Oliphant | 206/0.83 |
| 4,915,214 | A | * | 4/1990 | Wieder | 206/0.82 |
| 5,020,468 | A | * | 6/1991 | Ciminelli | 116/318 |
| 5,109,977 | A | * | 5/1992 | Mayer et al. | 206/0.8 |
| 5,407,064 | A | * | 4/1995 | Huang | 206/0.8 |
| 5,590,761 | A | | 1/1997 | Owen | |
| D378,222 | S | | 2/1997 | Svrcek | |
| 5,768,915 | A | | 6/1998 | Crumrine et al. | |
| 5,884,755 | A | | 3/1999 | Vaccarella | |
| 5,988,365 | A | | 11/1999 | McAdams | |

FOREIGN PATENT DOCUMENTS

| | | |
|---|---|---|
| GB | 1106395 | 3/1968 |

* cited by examiner

*Primary Examiner*—Shian Luong
(74) *Attorney, Agent, or Firm*—Richard C. Litman

(57) ABSTRACT

A coin display case provides for the selective viewing of each face of each coin displayed, independently of other coins displayed therein. The case has a base with a storage drawer, with a sloped display area thereabove for the flat display of coins which do not fit the pivotally mounted holders of the rest of the case. A shelf mounting area at the back of the base provides for a series of coin display shelves to be stacked thereon. Each shelf comprises a rectangular frame with a series of opposed coin holder pivots extending inwardly from each major wall. The pivots enable coins held therebetween to be pivoted about their vertical axes, for viewing both sides of commemorative coins minted with both faces having the same orientation. Alternatively, the shelves may be placed with the pivots aligned horizontally, for viewing both sides of monetary coins having relatively inverted opposite faces.

20 Claims, 5 Drawing Sheets

COIN DISPLAY CASE

BACKGROUND OF THE INVENTION

1. Field of the Invention

The present invention relates generally to racks, shelves, and the like, and more particularly to a modular display case or shelving for the display of a series of coins. One or more frames are provided atop a base, with each of the frames having a series of independently rotatable elements for the display of both sides of a coin held therein. The frames are horizontally disposed with vertical coin rotational axes for the display of commemorative coins, where the obverse and reverse faces have the same orientation. An alternative orientation is also provided, for monetary coins with relatively inverted obverse and reverse faces.

2. Description of the Related Art

Coins, medals, and the like stamped from a flat piece of metal have been used in trade from the earliest times of recorded history. Generally, such coins are stamped on both sides (known as obverse and reverse sides) from relatively small discs of precious or other metal. More recently, various manufacturers have developed innumerable coins, medals, and the like to commemorate various events, associations, etc. These coins and medals are also generally stamped or minted from flat metal discs, with two opposed dies being used to form an image on both sides of the coin.

As interest has grown in the collection and display of such coins, various devices (stands, shelves, etc.) have been developed to provide for the display of various coins. Most such devices display the coins or medals resting upon a background of some sort, and thus display only a single side or face of the coin. While others have developed display devices which enable both sides of a coin to be viewed alternately, most such devices comprise a relatively large sheet or plate in which a series of coins are immovably affixed, with it being necessary to turn the entire sheet or plate to view the opposite sides of the coins. In other words, there is no way to turn a single coin independently of the others, to view the reverse face of only a single coin, and perhaps compare the reverse face to the obverse face of an adjacent identical coin.

As a result, there have been some limited efforts to provide coin display devices which enable each coin to be turned independently from one another. However, such devices generally comprise relatively large sheets or plates, and do not provide for modular addition to the display case as coins are added to the collection. Such displays commonly include large areas where no coins are installed, as it is impossible to remove portions of the display area for smaller collections.

Moreover, most such devices which provide for the rotation of coins within a display holder in order to view both sides of the coin alternately, are directed toward monetary coins. Monetary coins almost universally have their obverse and reverse sides stamped inverted relative to one another. Thus, the rotational axis for mounting the coin must be horizontal to position both the obverse and reverse sides of the coins upright for the viewer. Commemorative coins and medals, also known as military coins which commemorate certain military units or events, are almost universally minted with the obverse and reverse sides oriented in the same direction. In other words, turning a commemorative coin over about a horizontal axis, as is done with monetary coins, results in the inversion of both faces of the coin. Such a system is unsuitable for use in displaying commemorative coins.

Accordingly, a need will be seen for a modular coin display case which provides for the selective display of both faces of commemorative coins, where the faces are oriented in the same direction. The present display case comprises one or more (preferably a series of) separable frames, with each of the frames being capable of holding a series of coins. Each of the coins in leach frame is separately mounted pivotally between opposite walls of the frame, thus allowing a person to inspect each side of a given coin independently of all other coins within a given frame and other coins and frames of the present display case. The base of the present display case provides for the display of non-circular and/or oddly shaped coins and medals, which do not fit the display frames. In another embodiment, the frames may be placed vertically atop the base so as to orient the pivotal axes for the coins horizontally, thus providing for the selective upright display of both faces of monetary coins, where those faces are inverted relative to one another.

A discussion of the related art of which the present inventor is aware, and its differences and distinctions from the present invention, is provided below.

U.S. Pat. No. 3,474,897 issued on Oct. 28, 1969 to Walter Rambow, titled "Display Device For Objects Such As Coins And The Like," describes a display board having a series of sockets into which a series of plugs may be removably installed. Each of the plugs holds a circular coin display holder thereon. In other embodiments, a series of ribs are placed on the board, with the ribs having shoulders for gripping the edges of the coin holders. None of the embodiments disclosed by Rambow provide for any movement of the coins displayed therein, unlike the present invention with its pivotally mounted coin holders and coins.

U.S. Pat. No. 3,776,643 issued on Dec. 4, 1973 to Victor Titoff, titled "Device For Simultaneously Displaying The Front And Rear Of Coins," describes a stand in which one or more coins are held by clips which hold their bottom edges. A mirror is provided in back of the coins, for viewing the reverse sides thereof. While the Titoff coin holder will work to a certain extent with commemorative coins, where their faces are oriented in the same direction, it cannot be made to work with monetary coins with relatively inverted obverse and reverse faces. In any event, the face viewed in the mirror of the Titoff holder is reversed, thus making it difficult to read any indicia, numbers, etc. thereon. The present display case enables each coin to be rotated independently of others so each face may be viewed directly.

U.S. Pat. No. 3,837,475 issued on Sep. 24, 1974 to Gerrit M. Bolanz, titled "Storage Device For Coins And Similar Objects," describes an adjustable rack for holding a single coin. The Bolanz device is adjustable to hold coins of different diameters, with the adjustable portion held in a sealed enclosure with transparent panels on each side thereof. Bolanz does not disclose any means for pivoting his coin holder or display device to allow a person to examine both sides of a coin alternately from one side of the device, as provided by the present invention.

U.S. Pat. No. 3,844,410 issued on Oct. 29, 1974 to Luther N. Cook, titled "Mounting Of Coins In The Faces Of Coin Albums," describes the pivotal mounting of coins in a relatively thin sheet of material, between a pair of horizontally opposed pivots. A selectively releasable lock is provided 90 degrees to the pivots, to hold the coins in the desired plane. While the Cook device enables the viewer to selectively pivot any given coin or coins from the plane of the holder sheet, the relatively thin nature of the sheets precludes the pivotal movement of any coins being held in closely adjacent sheets, i.e., when the album is closed or nearly closed. Each frame of the present coin display case might be considered analogous to one display sheet of the Cook album, with the frame edges of the present display case being aligned beside one another rather than being stacked in registry with one another, as are the pages of the Cook album. This enables any coin(s) in any frame(s) to be rotated without interference from any other frame(s), in the present display case.

U.S. Pat. No. 4,043,477 issued on Aug. 23, 1977 to Raymond E. Deese, titled "Coin Display," describes a series of generally rectangular, interlocking frames, each of which may hold a single coin between two transparent sheets of material. The coins are held in place by inserts which hold each coin centered within its corresponding frame. The relatively flat, thin configuration of the resulting assembly does not permit the coins to be rotated within their holders or display, as provided by the present coin display case invention.

U.S. Pat. No. 4,402,399 issued on Sep. 6, 1983 to Wolfgang Friess, titled "System For The Storage Of Coins And The Like," describes a flat plate sandwich structure for holding a series of coins therein. A central layer includes a series of passages therethrough for holding coins therein, with an unbroken clear sheet of material overlying the central sheet. As a result, any coins held in the Friess coin holder cannot be turned individually. The only way to see the obverse sides of the coins held in the Friess holder, is to turn the entire sheet over.

U.S. Pat. No. 5,590,761 issued on Jan. 7, 1997 to David B. Owen, titled "Coin Display Holder," describes a device having an opening with a series of three generally radially disposed flexible arms extending inwardly from the wall of the opening. The arms serve to grip the edges of the coin and hold it within the opening. The Owen holder works well for irregularly shaped coins, but cannot provide for rotation of the coin to view both sides thereof from one side of the holder, as does the present coin display case.

U.S. Pat. No. 5,768,915 issued on Jun. 23, 1998 to David Crumrine et al., titled "Coin Display Device," describes an assembly for displaying one face of a coin in a belt buckle, ring, or the like. The Crumrine et al. assembly sandwiches the coin beneath a transparent window, which is in turn assembled in a buckle assembly or the like. While Crumrine et al. state that both sides of the captured coin may be viewed selectively, their holder holds only a single coin and does not provide for turning or rotating a single holder which is a part of a group of holders in a case, as is accomplished by the present invention.

U.S. Pat. No. 5,884,755 issued on Mar. 23, 1999 to Richard M. Vaccarella, titled "Revolving Coin Display Stand," describes a desktop display stand for proof sets involving a limited number of coins. The Vaccarella stand allows a person to turn over the entire display portion to view the obverse sides of the coins, but the coins cannot be turned individually and independently of one another, as in the present display case. Moreover, the Vaccarella stand is directed only to coins having their obverse and reverse sides inverted relative to one another, and would invert both faces of commemorative coins when used with such coins and turned.

U.S. Pat. No. 5,988,365 issued on Nov. 23, 1999 to Natalie D. McAdams, titled "Coin Display Case," describes a device resembling the Vaccarella coin display holder described immediately above, in that it also holds a series of coins in a single holder which may be rotated about a horizontal axis. The same distinctions noted with the Vaccarella holder, are seen to apply here as well.

U.S. Pat. No. D-378,222 issued on Feb. 25, 1997 to Maria Svrcek, titled "Gold Chocolate Coin Display," illustrates a design having the appearance of a transparent suitcase or attache case randomly filled with coins, most of which overlap one another. No means is apparent for displaying the coins individually, nor for rotating them either collectively or individually to show their reverse faces, as provided by the present coin display case invention.

Finally, British Patent Publication No. 1,106,395 published on Mar. 13, 1968 to Jan Wolfert, titled "Improvements In Coin Albums," describes a sheet having one or more relatively large holes therein, with a series of concentrically fitting rings for selectively installing within each hole. This system permits coins of virtually any size to be installed securely within the holes in the sheet, using none, or one or more, of the rings for fit. As the coins are immovably held within the sheet by the fitting rings, the coins cannot be rotated out of the plane of the sheet to examine their reverse sides, as is permitted by the present coin display case invention.

None of the above inventions and patents, taken either singularly or in combination, is seen to describe the instant invention as claimed. Thus a coin display case solving the aforementioned problems is desired.

SUMMARY OF THE INVENTION

A coin display case provides for the reversible viewing of a series of coins displayed therein, with each of the coins being selectively reversible within the case, independently of other coins. The present case comprises a base having a drawer therein for the storage of undisplayed coins, additional mounting brackets or holders, information sheets or brochures, etc. as desired. The upper portion of the base is sloped and includes a tray therein for the display of irregularly shaped coins or others which do not fit the vertically disposed display shelves of the present display case. The back of the base has a coin display shelf mounting area extending thereacross for the installation of a horizontally disposed coin display shelf thereon, with additional horizontal shelves being stackable atop the first shelf.

Each shelf comprises an open rectangular frame, with a series of opposed pivot pairs extending inwardly from the opposite walls thereof. Each pivot pair serves to capture a coin pivotally therebetween, thus allowing each coin to be pivoted or rotated independently of others in order to view each face selectively as desired. The vertical pivot axes thus provided are adapted for viewing the opposite faces of commemorative or military coins, which are conventionally minted or stamped with both faces oriented in the same direction. Alternatively, the shelves of the present display case may be installed with their longitudinal axes oriented vertically, to orient the coin rotational axes horizontally for proper orientation of the mutually inverted faces of monetary coins.

Accordingly, it is a principal object of the invention to provide a coin display case providing for the selective display off both sides of each coin of a series of coins secured therein, with the display of each side of each coin being independent of other coins in the display case.

It is another object of the invention to provide such a coin display case in which each coin is mounted between a pair of vertically opposed holder axes in a shelf frame, allowing the coin to be rotated about its vertical axis for proper display of opposed coin faces having the same relative orientation.

It is a further object of the invention to provide such a coin holder having a base with a storage drawer and display tray for additional coins, with the base further having a mounting area for the first shelf of a series of stackable shelves, each of which provides for pivotally holding a series of coins therein.

Still another object of the invention is to provide such a coin holder in which the shelves may be oriented with their pivoting coin holders disposed horizontally, for the pivotal display of opposed coin faces where the coin faces are inverted, relative to one another.

It is an object of the invention to provide improved elements and arrangements thereof for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a coin display case, providing for the display of a series of coins having obverse (front) and reverse (back) faces or sides. The present display case allows the observer to rotate any coin to view either face thereof, independently of other coins displayed therein.

Figure 1:
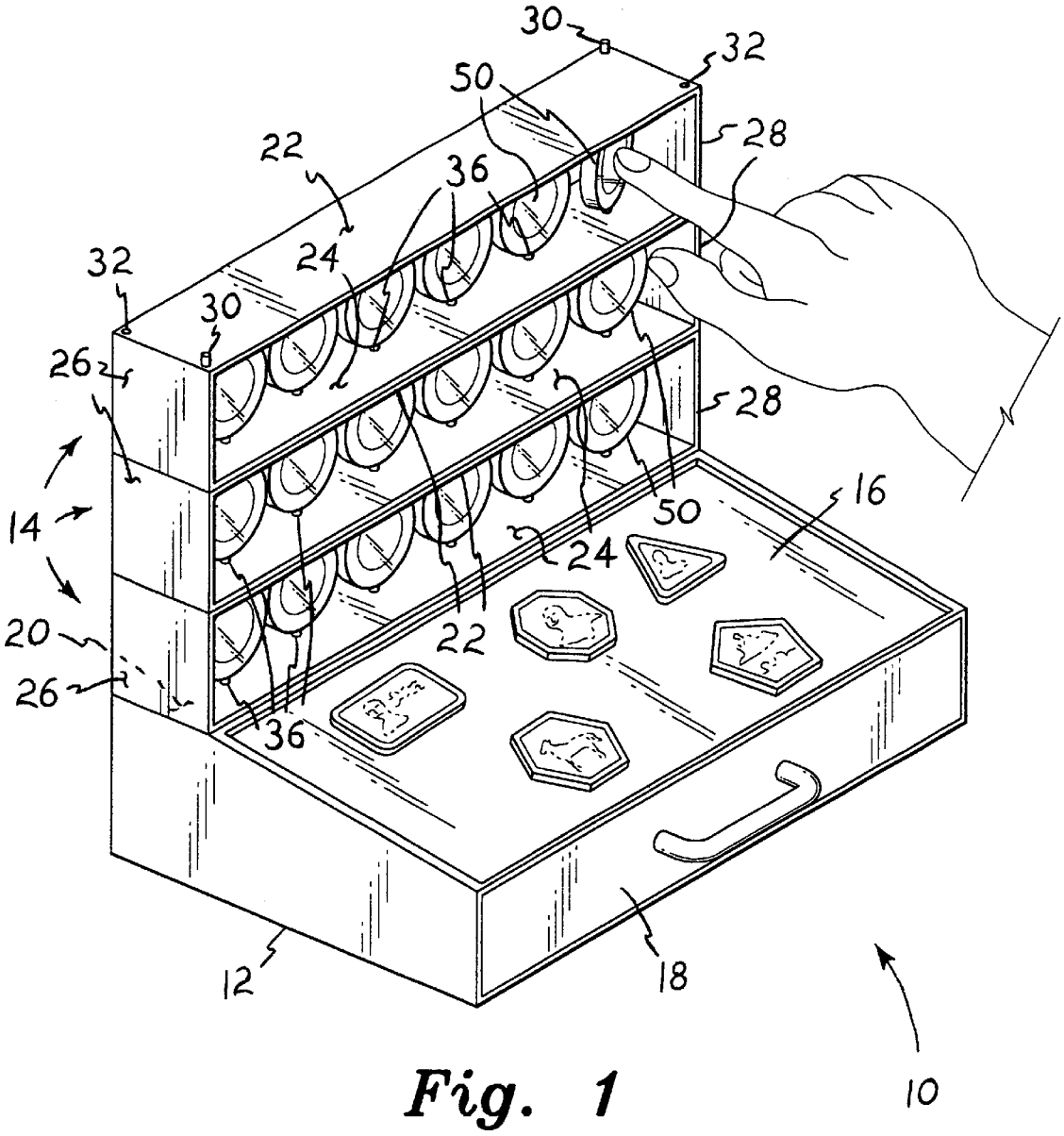
FIG. 1 is a perspective view of a coin display case according to the present invention, showing the selective rotation of an individual coin holder in one of the display shelves of the case
Figure 2:
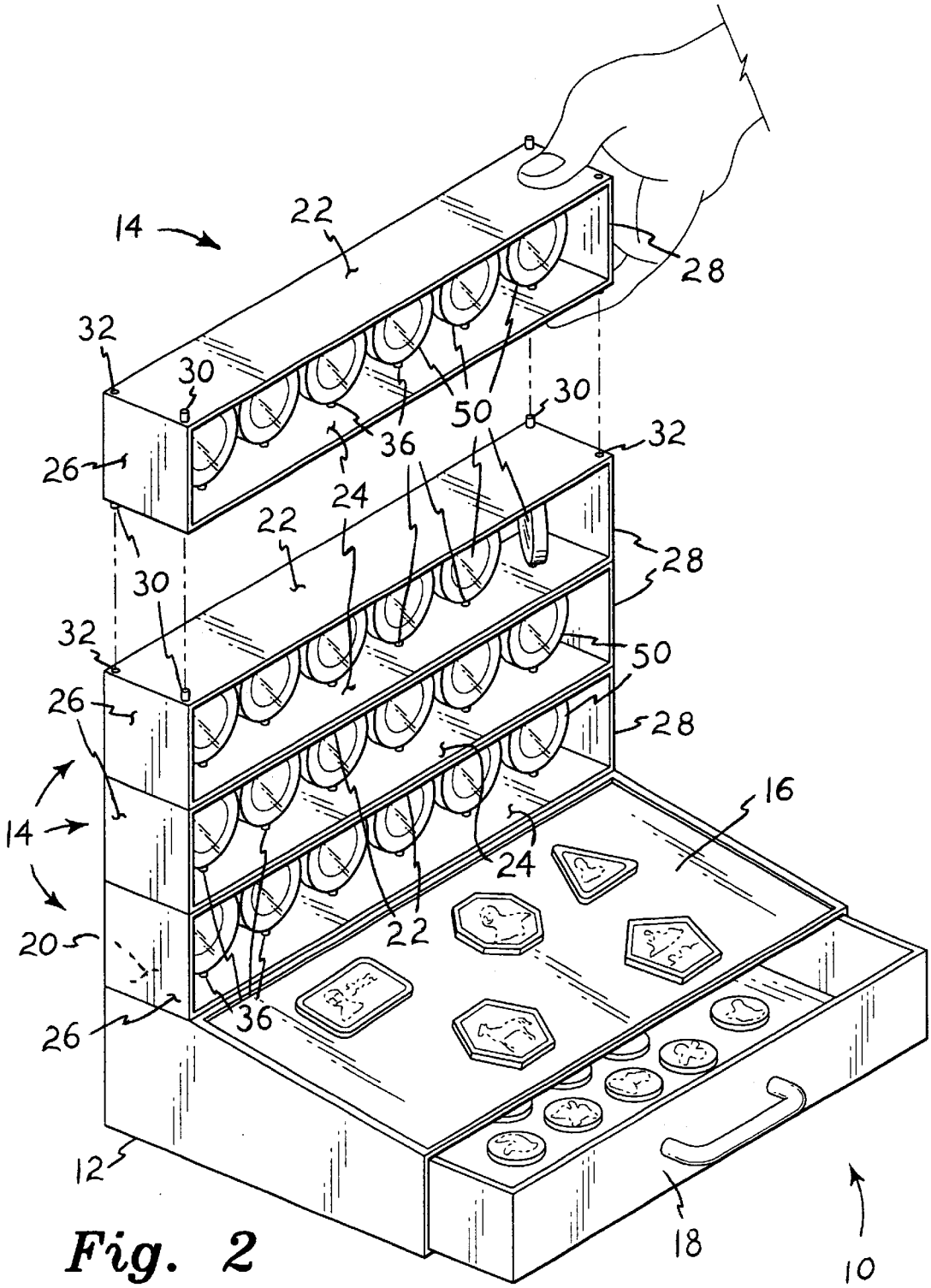
FIG. 2 is an exploded perspective view of the present coin display case, showing the stacking of a series of coin display shelves atop the base and one another.

FIGS. 1 and 2 of the drawings provide perspective views of a first embodiment of the present coin display case 10. The case 10 is modular, comprising a base portion 12 with one or more coin display shelves 14 removably stacked there atop. The base portion 12 preferably includes a forwardly and downwardly sloped display area 16, which provides for the display of non-circular or other oddly shaped coins and the like, which do not fit the series of coin holders provided with the display shelves 14. A drawer 18 is provided within the base 12, for the storage of coins which are not being displayed, information relating to those or other coins, additional holders for coins to be displayed in the shelves 14, etc. The rearward portion of the upper surface of the base 12 includes a flat, level (i.e., parallel to the bottom of the base 12) coin display shelf mounting area 20 (shown more clearly in the alternate embodiment of FIG. 5), upon which one or more coin display shelves 14 may be removably stacked.

All of the coin display shelves 14 of the present display case 10 of FIGS. 1 and 2 are identical to one another, and comprises generally rectangular frames having opposed first and second major walls, respectively 22 and 24, with opposed first and second minor walls, respectively 26 and 28, extending across the coin display area between the ends of the two major walls or panels 22 and 24. Each of the shelves or frames 14 is open to the front and rear thereof, i.e., to the side facing over the display area 16 of the base 12, and the opposite side, in order to provide access to and clearance for the pivotal mounting of coins within each shelf 14.

While the present coin display case 10 may be provided with only a single coin display shelf 14, with that shelf 14 having means for holding and displaying only a single coin therein, preferably a plurality of essentially identical coin display shelves 14 are provided, with each including a series of coin holding devices therein. Each of the shelves 14 preferably includes some means of interlocking with one another and with the display shelf mounting area 20 of the base 12, e.g., cooperating pins 30 and receptacles 32 extending from the first and second major walls 22 and 24 of the shelves 14, or other means as desired. While these pins 30 and receptacles 32 are shown in an alternating array extending from each wall or panel 22 and 24 of each shelf 14, it will be seen that all pins 30 could extend from the first wall 22 with all receptacles 32 being formed in the opposite second wall 24 of each panel, or otherwise as desired, so long as corresponding pins 30 and receptacles 32 cooperate with one another.

Figure 3:
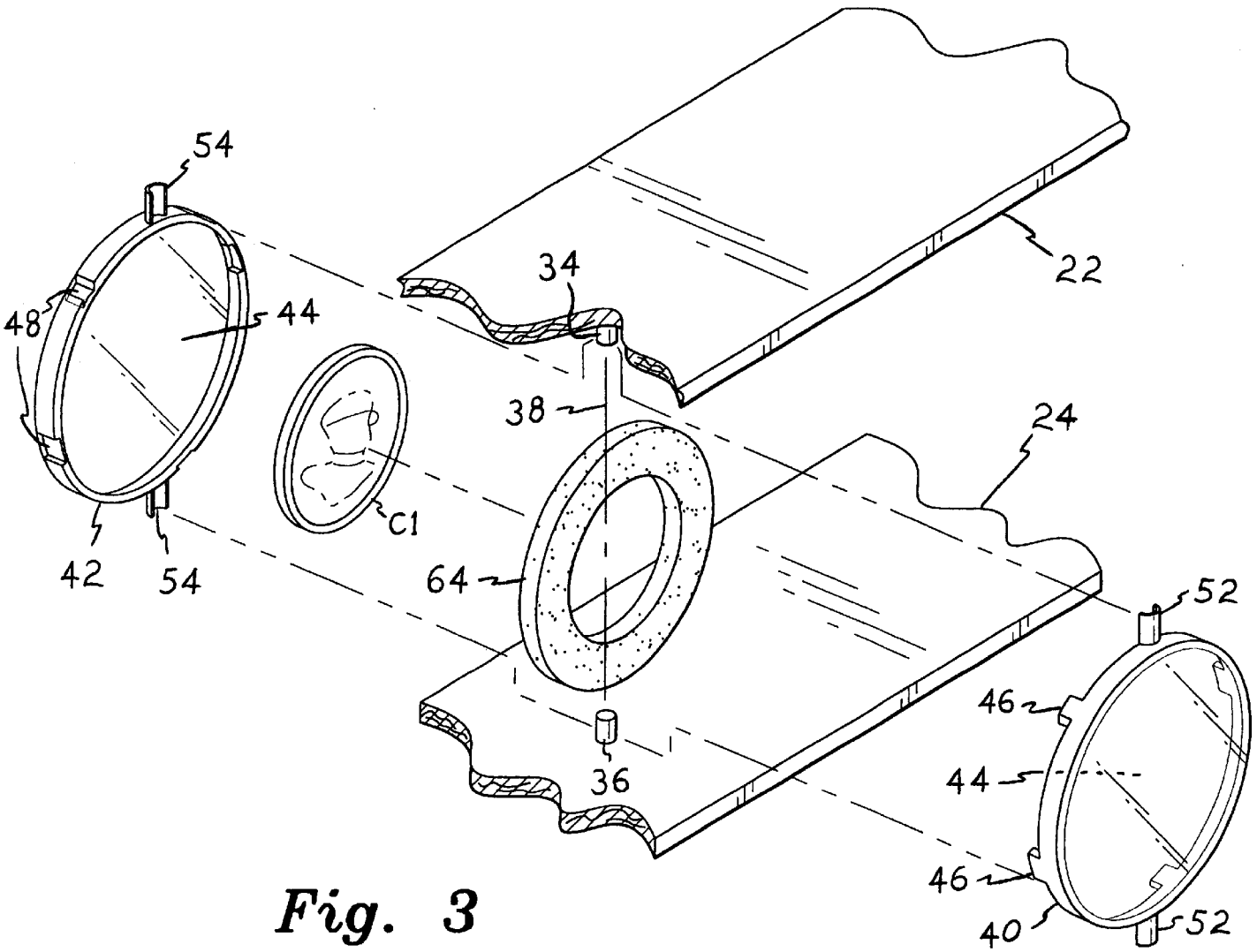
FIG. 3 is an exploded perspective view of a first embodiments of an individual holder and pivot assembly, showing details thereof.
Figure 4:
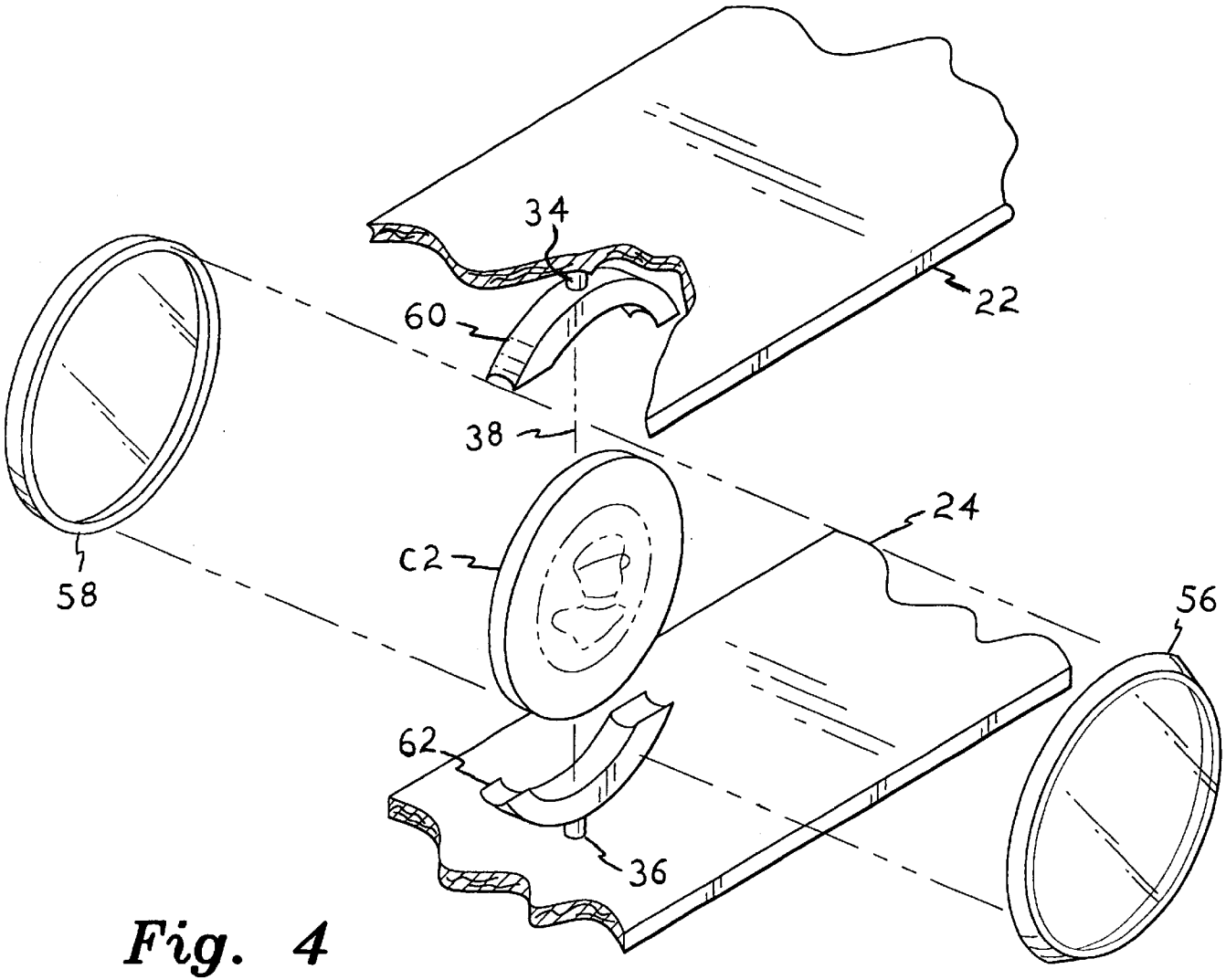
FIG. 4 is an exploded perspective view of a second embodiments of an individual holder and pivot assembly, showing details thereof.

The first major wall 22 of each coin holder shelf 14 includes at least one first coin holder pivot 34 extending inwardly therefrom (shown in FIGS. 3 and 4 of the drawings), with the opposite second major wall 24 having at least one second coin holder pivot 36 extending inwardly therefrom, opposite the corresponding first coin holder pivot 34 to define a generally vertical coin holder pivot axis 38 therebetween; the coin holder pivot axis 38 is illustrated in the broken away exploded perspective views of FIGS. 3 and 4 of the drawings. While each shelf 14 may have only a single first and second coin holder pivot 34 and 36 therein for the display of a single coin, preferably each shelf 14 includes a series of first and second coin holder pivots 34 and 36, with each first pivot 34 being disposed opposite to and corresponding with a second pivot 36 to define a series of coin holder pivot axes 38 therebetween for each coin holder shelf 14.

FIG. 3 of the drawings provides a broken away, exploded perspective view of a first embodiment of a coin holder assembly as it would be assembled with the first and second walls or panels 22 and 24 of one of the coin holder shelves 14. The coin holder assembly of FIG. 3 comprises transparent first and second coin covers, respectively 40 and 42, with the two covers 40 and 42 including means for removably securing the two covers 40 and 42 together as desired to provide a coin holding area 44 therein and encapsulate a coin C1 therebetween. For example, the first coin cover 40 may have a series of projecting tabs or ears 46 extending from the periphery thereof, with the second coin cover having a corresponding series of peripheral receptacles or slots 48, with the mating tabs 46 of the first cover 40 engaging the slots 48 of the second cover 42 to secure the two covers together as desired. Alternatively, the tabs 46 and slots 48 may be alternated about the periphery of each cover 40 and 42, with each cover being identical to the other and with the alternating tabs 46 and slots 48 of one cover engaging the corresponding slot and tab arrangement of the opposite cover. The two coin holder covers 40 and 42 secure removably together to form a coin holder assembly 50, as shown in FIGS. 1 and 2.

Each cover 40 and 42 further includes some form of coin holder pivot attachment means extending therefrom. For example, the first coin holder cover 40 may include a pair of opposed, semi-cylindrical first pivot attachment shells 52 extending therefrom, with the second cover 42 having an essentially identical pair of opposed second pivot attachment shells 54 extending therefrom. When the, two covers 40 and 42 are assembled together to form a completed coin holder 50 and enclose the coin C1 therein, each corresponding first and second shell 52 and 54 form a completed cylindrical receptacle around the corresponding first or second pivot 34 or 36, thus securing the coin holder assembly 50 pivotally between the first and second walls or panels 22 and 24 of the shelf 14.

An alternative coin holder assembly is illustrated in FIG. 4, wherein a pair of identical transparent first and second coin holder covers 56 and 58 are shown capturing a coin C2 within the coin holding area defined therein. The two coin holder components, 56 and 58 of FIG. 4 have no means for securing to one another, but instead are held together by the alternative pivot arrangement shown extending from the two pivots 34 and 36. The first and second pivots 34 and 36 have respectively opposed resilient first and second coin cover grips 60 and 62 extending therefrom, each comprising a concave, arcuate shape for gripping the edge of the coin cover assembly therein. The resilience of the two coin cover grips 60 and 62 allows the two coin covers 56 and 58 comprising a completed coin cover assembly to be snapped in place between the two grips, thus pivotally holding the coin C2 in place for display.

It is well known that coins, whether commemorative or monetary, are produced in a wide variety of different diameters. For example, it will be noted that the exemplary coin C1 shown in FIG. 3 of the drawings is somewhat smaller in diameter than the coin C2 illustrated in FIG. 4. The differences in coin sizes could be accommodated by providing a series of coin holder assemblies having different internal diameters. However, this would add to the cost and complexity of the present coin display case, and would perhaps burden the collector with a series of unwanted coin holders for coin diameters which he or she does not possess.

Accordingly, the present invention includes means for securing coins of different diameters within the single diameter coin cover assemblies of the present invention. In FIG. 3, a spacer 64 is shown which fits around the coin C1 and removably within the two covers 40 and 42 of the coin cover assembly. The spacer 64 is preferably formed of a relatively soft and resilient foam plastic material, but other suitable materials may be used as desired. The spacer 64 has an outside diameter formed to fit closely within the coin holding area 44 of the covers 40 and 42, and an inner diameter formed to fit closely around the coin C1 to hold the coin C1 immovably within the two coin covers 40 and 42 when they are assembled together. A series of spacers having different internal diameters for different coins, may be provided. Alternatively, the spacer 64 may include a series of prepunched concentric rings, allowing the coin collector to remove the number of rings desired to provide the desired diameter for proper fit of a coin therein.

The present coin display case invention is particularly well suited for the display of commemorative and military type coins, where the obverse and reverse sides or faces of such coins are oriented in the same direction relative to one another, i.e., when one face is oriented upright and the coin is turned over from left to right, the opposite face has the same upright orientation relative to the viewer. This is why the coin display shelves 14 of the coin display case embodiment of FIGS. 1 and 2 are disposed with their major walls 22 and 24 oriented generally horizontally, and their coin holder pivots 34 and 36 are oriented to define vertical coin pivot axes therebetween, when the shelves 14 are installed atop the base 12 of the display case 10 of FIGS. 1 and 2. In this manner, a person may pivot each coin left to right (or right to left) about its vertical axis, independently of any and all other coins, with both the obverse and reverse face of such a military or commemorative coin remaining upright for proper orientation.

It will be seen that the orientation of the shelves 14 so that their major axes or walls 22 and 24 are oriented vertically, would have the effect of turning the pivot axes to align with the horizontal. While such an arrangement is not suited for military and commemorative coins, it is well suited for monetary type coins, which generally have their obverse and reverse faces relatively inverted, so that when one face is upright, the coin must be turned from top to bottom to position the opposite face in an upright orientation.

Figure 5:
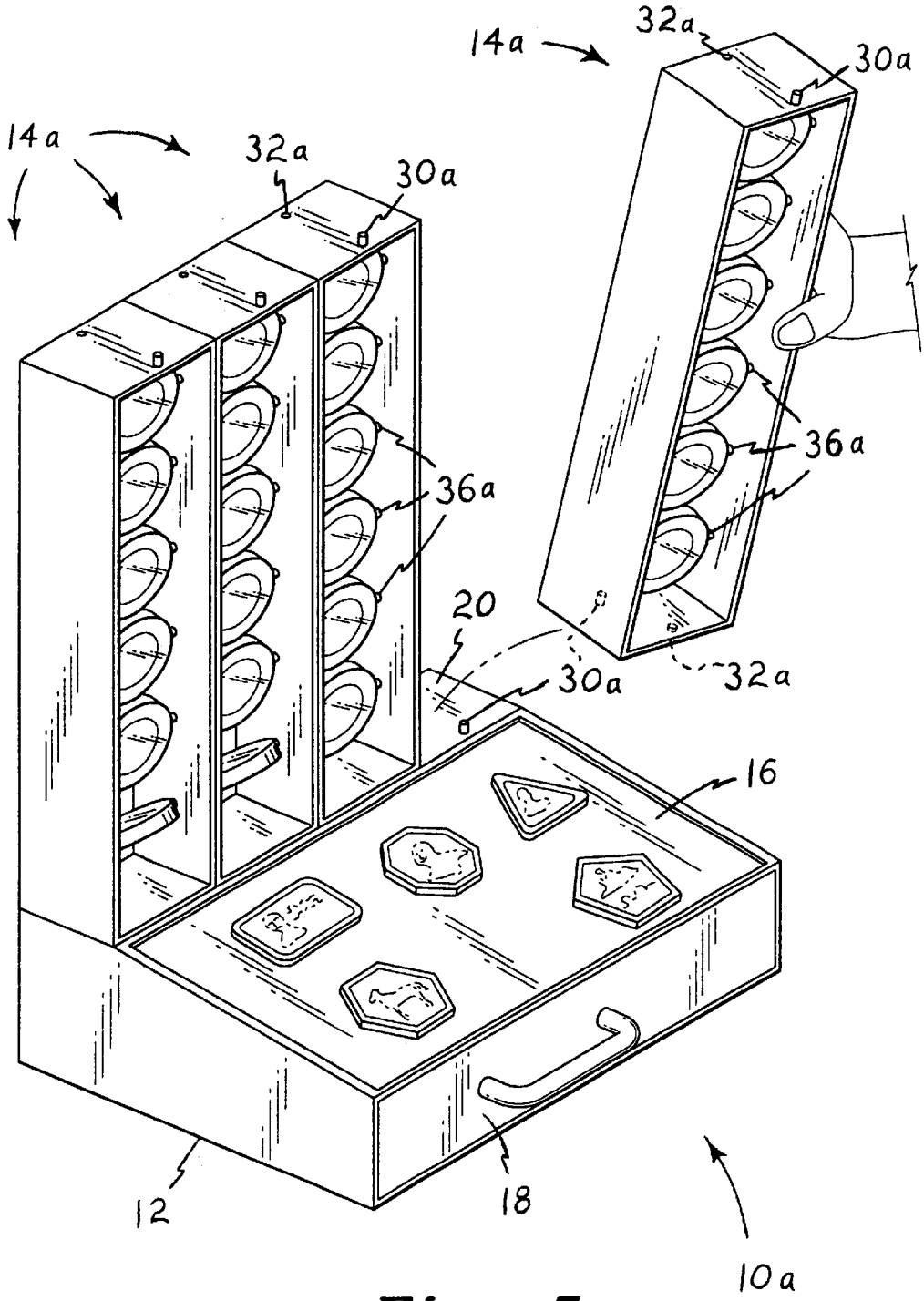
FIG. 5 is an exploded perspective view of an alternate embodiment of the present coin display case, showing the horizontal orientation of the coin holder pivots in a series of vertically disposed shelf units.

Accordingly, FIG. 5 of the drawings illustrates an alternative embodiment for the pivotal mounting and display of such coins with relatively inverted obverse and reverse faces. In the embodiments of FIG. 5, the display case 10*a* includes a base 12 substantially the same as the base 12 of the case 10 of FIGS. 1 and 2. The base 12 includes a display shelf mounting area 20 at the upper rear portion thereof, as in the case 10 of FIGS. 1 and 2. However, the coin display shelves 14*a* of the case 10*a* of FIG. 5, differ from the shelves 14 of the embodiment of FIGS. 1 and 2 in that the shelves 14*a* are oriented 90 degrees to the substantially horizontal orientation of the shelves of the embodiment of FIGS. 1 and 2.

This positions the shelves 14*a* with the lengths of their major walls oriented substantially vertically when installed on the base 12, with the corresponding coin holder pivots defining a series of generally horizontally disposed coin display pivot axes. (Only one set of the coin holder pivots 36*a* is shown in FIG. 5, but it will be understood that the opposite pivots, in combination with the illustrated pivots 36*a*, form essentially the same relationship as that shown in FIGS. 3 and 4, with the exception that their coin pivot axes are horizontal.) Shelves 14*a* and the shelf attachment area 20 preferably include a series of cooperating pins 30*a* and receptacles 32*a* for removably securing the shelves 14*a* to the shelf area 20 of the base 12 of the display case 10*a* embodiment of FIG. 5. This arrangement allows monetary coins with relatively inverted obverse and reverse faces, to display each face in an upright orientation due to the horizontal coin cover assembly pivot axes.

In conclusion, the present coin display case provides great versatility and flexibility over other coin displays of the prior art. The present display case is particularly well suited for the display of commemorative and military coins, with their obverse and reverse faces having the same relative orientation to one another. However, the present display case may also be easily modified for the display of monetary type coins, with their relatively inverted faces. The present display case, with its modular configuration, allows the collector to assemble perhaps only a single display shelf atop the back of the base unit, for the display of only a few coins. However, as the collection expands, the collector can add, more shelves atop the previously installed shelf or shelves, thus expanding the display space as the collection expands.

The pivotal mounting of the individual coin holders of the present display case, allows persons viewing the coins to view each side of a single coin as desired, without need to turn a large sheet of material in which a series of coins are installed, or otherwise displace or turn a number of additional coins. The ease of viewing provided by the present display case, along with the versatility of the modular nature of the device, will prove to be extremely popular with numismatists and those who collect and display commemorative, military, and/or other types of coins ash well.

It is to be understood that the present invention is not It limited to the embodiments described above, but encompasses any and all embodiments within the scope of the following claims.

I claim:

1. A coin display case comprising:

a base;

a rearwardly disposed coin display shelf mount atop said base;

at least one coin display shelf removably installed generally horizontally atop said coin display shelf mount of said base;

said at least one coin display shelf comprising a rectangular frame having opposed, generally horizontal first and second major walls with opposed, generally vertical first and second minor walls therebetween;

at least one coin holder first pivot extending inwardly from said first major wall; and at least one coin holder secod pivot extending inwardly from said second major wall and opposite said at least one coin holder first pivot, so that said at least one coin holder first pivot and said at least one coin holder second pivot define a generally vertical coin holder pivotal axis therebetween.

2. The coin display case according to claim 1, wherein:

said at least one coin display shelf comprises a plurality of coin display shelves; and each of said shelves includes cooperating means for removably securing one of said shelves to another of said shelves.

3. The coin display case according to claim 1, wherein:

said at least one coin display shelf includes a plurality of coin holder first pivots extending from said first wall thereof, and a corresponding plurality of coin holder second pivots extending from said second wall thereof; and each of said coin holder first pivots is disposed opposite a corresponding one of said coin holder second pivots.

4. The coin display case according to claim 1, further including at least one coin holder, comprising:

a transparent first coin cover;

a transparent second coin cover;

each said coin cover further including means for mutually and releasably gripping the other said coin cover and defining a coin holding area therein when said first coin cover is secured to said second coin cover; and each said coin cover further including first and second coin holder pivot attachment means extending therefrom.

5. The coin display case according to claim 1, further including at least one coin holder, comprising:

a transparent first coin cover;

a transparent second coin cover;

each said coin cover defining a coin holding area therein when said first coin cover is secured to said second coin cover; and a first arcuate coin cover grip extending from said at least one coin holder first pivot;

a second arcuate coin cover grip extending from said at least one coin holder second pivot; and said first and said second arcuate coin cover grip removably holding said coin cover therebetween.

6. The coin display case according to claim 1, further including:

a transparent first coin cover;

a transparent second coin cover; and a spacer removably disposed between said first and said second coin cover, for securely holding a coin therein.

7. The coin display case according to claim 1, further including a storage drawer disposed within said base.

8. The coin display case according to claim 1, further including a base display area disposed atop said base.

9. The coin display case according to claim 8, wherein said base display area is sloped downwardly and forwardly from said coin display shelf mount.

10. A coin display case comprising:

a base;

a rearwardly disposed coin display shelf mount atop said base;

at least one coin display shelf removably installed atop said coin display shelf mount of said base;

said at least one coin display shelf comprising a rectangular frame having opposed first and second major walls with opposed first and second minor walls therebetween;

at least one coin holder first pivot extending inwardly from said first major wall; and at least one coin holder second pivot extending inwardly from said second major wall and opposite said at least one coin holder first pivot, so that said at least one coin holder first pivot and said at least one coin holder second pivot define a coin holder pivotal axis therebetween.

11. The coin display case according to claim 10, wherein:

said major walls of said at least one coin display shelf are oriented generally horizontally when said at least one coin display shelf is removably installed upon said base; and each said coin holder pivot is oriented generally vertically when said at least one coin display shelf is removably installed upon said base.

12. The coin display case according to claim 10, wherein:

said major walls of said at least one coin display shelf are oriented generally vertically when said at least one coin display shelf is removably installed upon said base; and each said coin holder pivot is oriented generally horizontally when said at least one coin display shelf is removably installed upon said base.

13. The coin display case according to claim 10, wherein:

said at least one coin display shelf comprises a plurality of coin display shelves; and each of said shelves includes cooperating means for removably securing one of said shelves to another of said shelves.

14. The coin display case according to claim 10, wherein:

said at least one coin display shelf includes a plurality off coin holder first pivots extending from said first wall thereof, and a corresponding plurality of coin holder second pivots extending from said second wall thereof; and each of said coin holder first pivots is disposed opposite a corresponding one of said coin holder second pivots.

15. The coin display case according to claim 10, further including at least one coin holder, comprising:

a transparent first coin cover;

a transparent second coin cover;

each said coin cover further including means for mutually and releasably gripping the other said coin cover and defining a coin holding area therein when said first coin cover is secured to said second coin cover; and each said coin cover further including first and second coin holder pivot attachment means extending therefrom.

16. The coin display case according to claim 10, further including at least one coin holder, comprising:

a transparent first coin cover;

a transparent second coin cover;

each said coin cover defining a coin holding area therein when said first coin cover is secured to said second coin cover; and a first arcuate coin cover grip extending from said at least one coin holder first pivot;

a second arcuate coin cover grip extending from said at least one coin holder second pivot; and said first and said second arcuate coin cover grip removably holding said coin cover therebetween.

17. The coin display case according to claim 10, further including:

a transparent first coin cover;

a transparent second coin cover; and a spacer removably disposed between said first and said second coin cover, for securely holding a coin therein.

18. The coin display case according to claim 10, further including a storage drawer disposed within said base.

19. The coin display case according to claim 10, further including a base display area disposed atop said base.

20. The coin display case according to claim 19, wherein said base display area is sloped downwardly and forwardly from said coin display shelf mount.

* * * * *